US008102969B2

(12) United States Patent
Bittl

(10) Patent No.: US 8,102,969 B2
(45) Date of Patent: Jan. 24, 2012

(54) X-RAY DEVICE

(75) Inventor: Herbert Bittl, Nuremberg (DE)

(73) Assignee: Siemens Aktiengesellschaft, Munich (DE)

( * ) Notice: Subject to any disclaimer, the term of this patent is extended or adjusted under 35 U.S.C. 154(b) by 43 days.

(21) Appl. No.: 12/640,238

(22) Filed: Dec. 17, 2009

(65) Prior Publication Data

US 2010/0150314 A1 Jun. 17, 2010

(30) Foreign Application Priority Data

Dec. 17, 2008 (DE) ..... 10 2008 062 671

(51) Int. Cl.
*H01J 35/10* (2006.01)
*H01J 35/26* (2006.01)

(52) U.S. Cl. ..... 378/144; 378/130; 378/132; 378/141

(58) Field of Classification Search ..... 378/130, 378/132, 139, 141, 142, 144, 133
See application file for complete search history.

(56) References Cited

U.S. PATENT DOCUMENTS 3,956,653 A * 5/1976 Lauwasser ..... 378/128
4,210,371 A * 7/1980 Gerkema et al. ..... 378/133
4,332,428 A * 6/1982 Maruyama ..... 310/90.5
4,357,555 A * 11/1982 Gerkema et al. ..... 378/135
4,651,336 A * 3/1987 Le Guen et al. ..... 378/125
4,677,651 A 6/1987 Hartl et al.
5,541,975 A * 7/1996 Anderson et al. ..... 378/130
6,198,803 B1 3/2001 Osama et al.
6,295,338 B1 * 9/2001 Kuzniar et al. ..... 378/132
6,327,340 B1 12/2001 Runnoe
6,364,527 B1 * 4/2002 Kutschera ..... 378/200
6,396,901 B1 * 5/2002 Hell et al. ..... 378/130
6,430,260 B1 * 8/2002 Snyder ..... 378/130
6,430,261 B1 8/2002 Bathe
6,477,231 B2 * 11/2002 Snyder et al. ..... 378/130
6,546,078 B2 * 4/2003 Ide ..... 378/133
6,707,882 B2 * 3/2004 Bittner et al. ..... 378/130
7,187,757 B2 * 3/2007 Saint-Martin et al. ..... 378/130
7,515,687 B2 * 4/2009 Bernard et al. ..... 378/127
7,558,376 B2 * 7/2009 Anno ..... 378/130

* cited by examiner

*Primary Examiner* — Edward Glick
*Assistant Examiner* — Thomas R Artman
(74) *Attorney, Agent, or Firm* — Schiff Hardin LLP

(57) ABSTRACT

An x-ray device has a cathode aligned on a target region in a tube housing with a rotating anode unit. The rotating anode unit is borne to rotate around a rotational axis inside the tube housing. The rotating anode unit has a rotating anode plate with the target region and a shaft rotationally connected with the rotating anode plate. A magnetic bearing supports the shaft without contact in the tube housing. The rotating anode plate has an axial extension facing away from the shaft. The axial extension dips into a fluid-filled receptacle space of the tube housing for heat dissipation. Such an x-ray device allows high rotation speeds of the rotating anode unit, and thus a high operational power.

17 Claims, 1 Drawing Sheet

X-RAY DEVICE

BACKGROUND OF THE INVENTION

Field of the Invention

The invention concerns an x-ray device of the type having a cathode aligned on a target region; with a tube housing; with a rotating anode unit that is supported to rotate around a rotation axis within the tube housing, the rotating anode unit having a rotating anode plate with the target region and a shaft that is connected in a rotationally fixed manner with the rotating anode plate, and having a magnetic bearing that supports the shaft without contact in the tube housing. Such an x-ray device is particularly suited for use in computed tomography systems.

X-ray tubes of the above type are generally known. In such known x-ray tubes, the tube housing fashioned as a vacuum piston and produced from a glass or a suitable metal. The cathode aligned on the target region of the rotating anode plate is typically located in the tube housing. An additional housing that is clad with a material of very high density (for example lead) for radiation protection is provided as a default for external shielding.

In operation, the target region of the rotating anode plate is irradiated with an electron beam emanating from the cathode so that an x-ray beam is emitted as bremsstrahlung from the target region of the rotating anode. The target region becomes extremely hot as a result of the irradiation by the electron beam. Even at high rotation speeds of the rotating anode plate of more than 150 Hz, temperatures of up to 2800° C. can be reached at the target region. In order to quickly dissipate the created heat, the rotating anode plate is produced from a highly heat-conductive material, in particular of molybdenum or a molybdenum alloy. The target region itself can be formed to be heat resistant, for example formed of tungsten. Nevertheless, under these conditions the rotating anode plate heats to temperatures of up to approximately 1400° C. during operation.

An x-ray tube of the aforementioned type is known from U.S. Pat. No. 6,198,803 B1, for example. For magnetic bearing, magnetic rotor components are associated with the shaft. Axial and radial stabilization magnets are arranged as stator components outside of the tube housing. The stator components generate an effective magnetic that interacts with the rotor components, so that the shaft is borne without contact within the tube housing. To drive the rotating anode plate, the shaft is executed as a rotor of an electrical motor.

In contrast to a slide (contact) bearing, a magnetic bearing allows very high rotation speeds. Friction increases with increasing rotation speed given a slide bearing, but this limitation is not present for a magnetic bearing. A higher rotation speed of the rotating anode plate is desirable since the x-ray power can in principle be additionally increased while complying with the temperature limit for the target region. An increase of the diameter of the rotating anode is not necessary. With a slide bearing, however, the arising heat can be dissipated via heat conduction, but this is not possible for a magnetic bearing since the shaft rotates without contact. Magnetic bearings are additionally heat-sensitive. Even heat-tempered magnetic components begin to lose their functionality at temperatures above 200° C. since the magnetization gradually disappears. In particular, the Curie temperature can be exceeded for passive (i.e. permanently magnetized) components.

Various hybrid concepts have been proposed for this reason, wherein slide and magnetic bearings are combined to bear the shaft of the rotating anode unit. An x-ray device with a rotating anode unit is known from U.S. Pat. No. 6,430,261 B1, wherein the shaft is radially supported by a liquid metal slide bearing and wherein a magnetic bearing is provided for axial bearing. The heat of the rotating anode plate can be dissipated via the shaft across the sliding film of the highly heat-conductive liquid metal. The additional increase of the rotation speeds that achievable by such a hybrid concept, however, is still limited by the friction of the slide bearing.

In order to counteract damage to the magnetic bearing due to heat, U.S. Pat. No. 6,327,340 B1 discloses to direct the rotating anode plate in a magnetic bearing on both sides by respective shafts, and the shafts are respectively directed in segments in a liquid metal. A thermal closure of each shaft with the tube housing is established via the liquid metal, so the heat dissipation is improved.

SUMMARY OF THE INVENTION

An object of the present invention is to provide an x-ray device with a magnetic bearing in which damage to the magnetic bearing that is due to heat and an unwanted heating of the rotating anode plate is optimally avoided.

This object is achieved according to the invention by an x-ray device of the aforementioned type wherein the rotating anode plate has an axial extension facing away from the shaft, the axial extension dipping into a fluid-filled receptacle space of the tube housing for heat dissipation.

Conventional solutions start with cooling the bearing side of the rotating anode unit or providing a heat dissipation at that location. In particular, even a magnetic bearing should remain protected in this way. The invention is deviates in a surprising manner from this concept. The invention instead proceeds from the consideration that a direct heat dissipation from the rotating anode plate also leads to a thermal unloading of a magnetic bearing arranged at the shaft. Since the heat at the rotating anode plate is discharged, not only the rotating anode plate itself, but also the shaft (and therefore in particular the magnetic bearing), are less thermally loaded (stressed).

For direct heat dissipation from the rotating anode plate, this is provided with an axial extension facing away from the shaft, which axial extension dips into a fluid-filled receptacle space of the tube housing.

In other words, a thermal coupling with the tube housing is established via the axial extension of the rotating anode plate so that arising heat is quickly transferred from the rotating anode plate to the colder tube housing. The thermal closure between the axial extension or, respectively, the rotating anode plate and the tube housing hereby occurs via the fluid of the receptacle space. The selected fluid termination allows a rotation movement of the rotating anode plate relative to the tube housing given a consistent thermal coupling.

Since vacuum predominates inside the tube housing, it is recommended that a liquid metal be chosen as a liquid for the receptacle space. Liquid metals have a low vapor pressure and moreover possess a very good heat conductivity. A suitable liquid metal is, for example, gallium or a gallium alloy.

The connection of the axial extension to the tube housing corresponds to a certain degree to a type of slide bearing as it is used in a known manner for the rotatable bearing of a rotating anode unit relative to the tube housing. However, since the rotating anode unit is presently already stably borne in a magnetic bearing via its shaft, the accommodation of the axial extension in the receptacle space does not need to be fashioned as a slide bearing. Rather, the gap measurement between the receptacle space and the axial extension can be of markedly greater dimensions than would technically be necessary given a design as a slide bearing. While gap measurements in the range of approximately 10 to 20 μm are required given a liquid metal slide bearing, gap measurements from 100 to 200 μm can presently be realized to accommodate the axial extension in the receptacle space. In particular, the unwanted friction relationships that apply for a fluid slide bearing at high rotation speeds do not apply given such a design. The achievable rotation speeds are thus not limited by the accommodation of the extension in the fluid space.

The axial extension can be fashioned in once piece with the rotating anode plate. The axial extension can likewise be fashioned as a separate part that is connected (for example by soldering or bolting) with the rotating anode plate. In order to achieve a quick heat dissipation from the rotating anode plate to the tube housing, the axial extension is advantageously produced from molybdenum, from a molybdenum alloy or from stainless steel. Both molybdenum and stainless steel have a relatively high heat conductivity. If a liquid metal is used as a liquid in the receptacle space, molybdenum has a high corrosion resistance to most liquid metals. If stainless steel is used, due to the corrosive properties of the liquid metal, the stainless steel must be coated on its surface, for example by molybdenum. Such a coating can be produced by means of CVD (Chemical Vapor Deposition), for example.

The axial extension and the associated receptacle space in the tube housing can be fashioned in terms of design in many variants as long as the rotational coupling is ensured and the necessary sealing of the liquid from the inside of the tube is ensured. For example, the axial extension can be formed as a cylinder wall of a hollow cylinder, with the cylinder wall rotating in an annular receptacle space. However, the axial extension is advantageously fashioned as a massive central pin (peg) that dips (extends) into a hollow cylindrical receptacle space. Due to the massive design, the heat-conductivity value is increased. A labyrinth seal of relatively simple design in terms of structure can be provided to seal the pin from the receptacle space. Additional sealing lips that conduct the fluid or the liquid metal back into the receptacle space due to their corresponding alignment can be provided if necessary. Also if necessary, coating the edge of the receptacle space with a layer that cannot be wetted (for example made of $Al_2O_3$) can already effectively prevent the escape of fluid (in particular of the liquid metal, and may be sufficient by itself for that purpose).

The acquisition space itself can be directly molded into the tube housing. Alternatively, the receptacle space can be used as a bushing in the tube housing. The latter is particularly suitable to provide a flexible reaction to the liquid that is used (in particular to the liquid metal) with regard to the material of the wall of the receptacle space. For example, the material of the bushing can be produced from corrosion-resistant molybdenum. Alternatively, the bushing is produced from stainless steel, and the inner wall is coated to be corrosion-resistant. A very good thermal coupling of the liquid or, respectively, of the liquid metal to the tube housing is achieved both via molybdenum and via stainless steel.

In order to quickly discharge heat transferred via the axial extension from the rotating anode plate to the tube housing, it is recommended to cool the tube housing in the region of the receptacle space. For example, a cooling body that actively extracts heat can be placed on the tube housing at a corresponding point. In a preferred embodiment, the tube housing has a cooling conduit or is coupled to a cooling conduits in the region of the receptacle space. The heat transferred from the rotating anode plate to the tube housing is then quickly dissipated via the coolant located in the cooling conduit. The coolant can circulate in a circuit, wherein the heat of the coolant flowing out is extracted in a compressor far from the tube housing and the cooled coolant is resupplied to the tube housing.

The aforementioned measures keep the rotating anode plate at a desired temperature level by direct heat discharge during the operation of the x-ray device. This is achieved without the heat being discharged through the bearing of the shaft, as has previously been typical. Since the heat is transferred directly at the rotating anode plate to the tube housing, a magnetic bearing for bearing the shaft is less charged with heat. The measures thus enable the use of a magnetic bearing for contactless bearing of the rotating anode unit. Higher rotation speeds can be realized so that the radiation power of the electron beam can be increased in a desirable manner without exceeding the temperature limits for a magnetic bearing.

In a further preferred embodiment of the invention, the rotating anode plate is connected with the shaft via a heat insulation element. The shaft (and therefore the magnetic bearing connected therewith) are thereby additionally thermally decoupled from the rotating anode plate. Heat is not only transferred directly at the rotating anode plate to the tube housing, but also it is prevented that heat is quickly discharged from the rotating anode plate to the shaft. In this regard the magnetic bearing is "doubly" safe from heat.

The heat insulation element can be formed of, for example, a suitable material that corresponds to the necessary mechanical requirements given a relatively low heat conductivity. Under the vacuum conditions inside the tube housing, a corresponding ceramic is suitable as a heat insulation element, for example. This can be connected with the rotating anode plate via soldering or via bolting, for example. Aluminum, silicon or zirconium oxides or, respectively, mixed oxides of these are suitable as ceramics, for example. These ceramics exhibit a comparably low heat conductivity.

In a further preferred embodiment, the heat insulation element comprises a heat insulation part made of a ceramic which is composed of a number of layers of different materials in the axial direction. The heat conductivity is additional impaired in the axial direction via the design as a layered body since heat must be transferred across multiple interfaces. The heat transmission in the axial direction can be even further reduced for a layered body if the individual layers respectively adjoin one another via structured surfaces. The contacting cross section at the interfaces is reduced to a certain extent via a structured surface so that the heat conductivity rating additionally decreases. For example, grooves can be introduced into the interfaces so that the interfaces are only in direct contact with one another via the raised webs.

The heat conductivity rating can additionally be reduced by connecting the heat insulation element with the shaft through a reduced radial cross section. For example, the radial cross-section can be reduced starting from the rotating anode plate towards the transition to the shaft. For example, an embodiment as a hollow tube is suitable while maintaining a sufficient mechanical stability. In a hollow tube, heat can only be dissipated via the outer wall.

The heat transfer from the rotating anode plate to the shaft can finally additionally be reduced in that the heat path to be traveled by the heat is intentionally extended. In an advantageous embodiment, this occurs in that the wall of the hollow tube is upset in the axial direction to extend the heat path. In other words, the wall of the hollow tube is curved out, folded and bent back relative to the axial direction.

During the operation of the x-ray device, the rotating anode plate is still heated to temperatures above 1000° C. Heat can inasmuch still be transferred to the magnetic bearing via radiant heat emanating from the rotating anode plate. In order to shield the magnetic bearing against radiant heat, in a further preferred embodiment a radiation protection shield is arranged between the rotating anode plate and the shaft for shading. In order to decouple the radiation protection shield from the shaft or, respectively, the rotating anode unit, this is preferably attached to the tube housing. For shading, the radiation protection shield can advantageously be produced as a metal plate.

DESCRIPTION OF THE PREFERRED EMBODIMENTS

Figure 1:
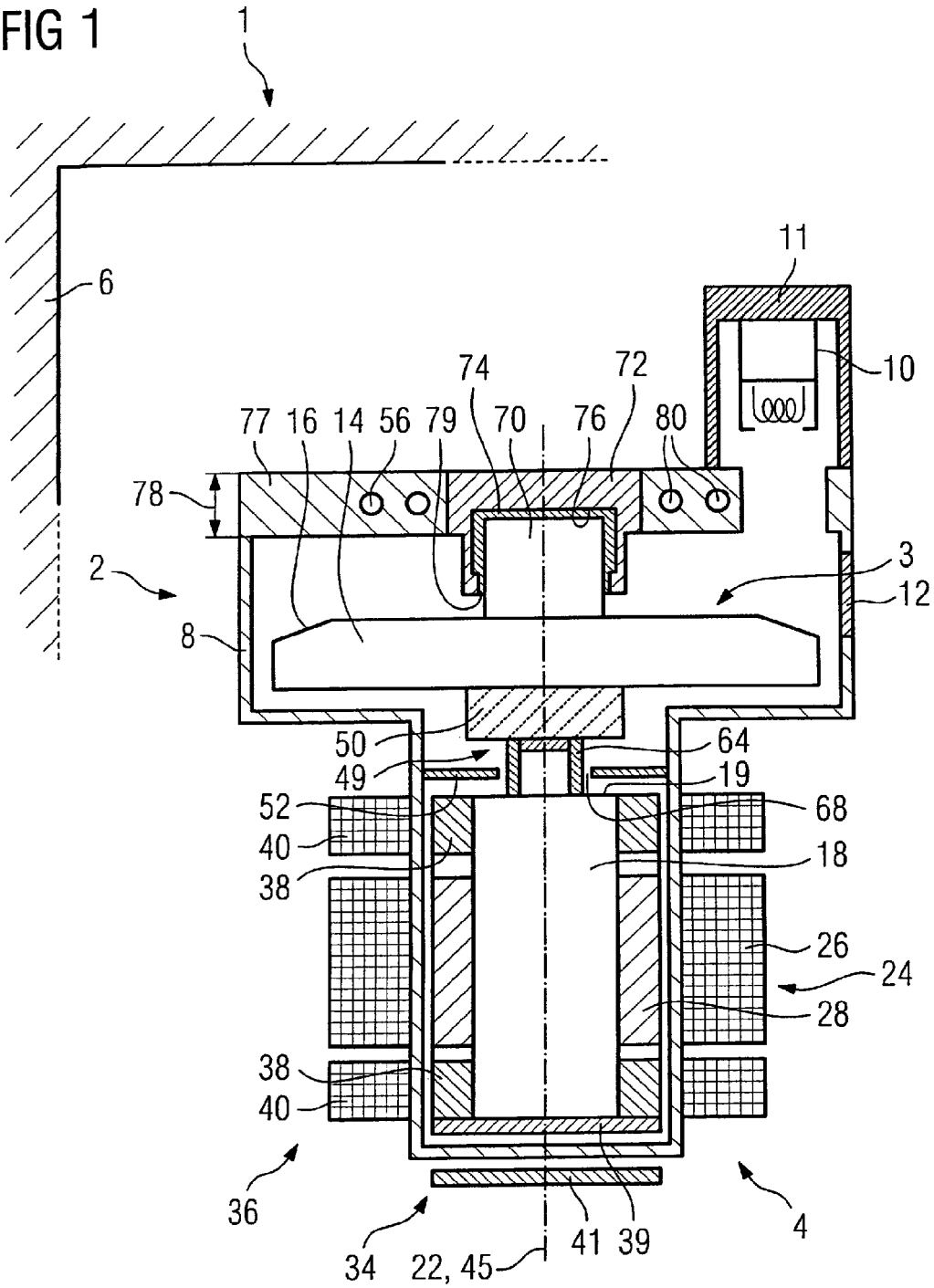
FIG. 1 schematically illustrates an x-ray device in an axial cross-section.

FIG. 1 shows a portion of an x-ray device 1 in cross-section. The shown x-ray device 1 has an x-ray tube 2 as well as a rotating anode unit 3. A magnetic bearing 4 is provided to support the rotating anode unit 3. The x-ray tube 2 as a whole is accommodated in a housing 6 of the x-ray device 1. The rotating anode unit 3 is arranged inside the tube housing 8.

The housing 6 is executed as an aluminum housing clad with lead for radiation shielding. The tube housing 8 of the x-ray tube 2 is presently produced from metal. High vacuum prevails inside the x-ray tube 2. To generate x-ray radiation, a cathode 10 is provided that presently is inserted into the tube housing 8. During operation, the cathode 10 lies at a high voltage potential relative to the rotating anode unit 3. The rotating anode unit 3 and the tube housing 8 lie at ground potential. For isolation of the high voltage, the cathode 10 is covered with an insulator 11. A window 12 which enables the exit of the generated x-rays from the x-ray tube 2 is inserted into the tube housing 8.

The rotating anode unit 3 arranged inside the tube housing 8 comprises a rotating anode plate 14 with a target region 16. The rotating anode plate 14 is coupled in a rotationally fixed manner to a shaft 18. The shaft 18 is borne without contact by means of the magnetic bearing 4 such that it can rotate around a rotation axis 22.

To drive the rotating anode unit 3, a segment of the shaft 18 is fashioned as a rotor 28 of an electrical motor 24. For this the electrical motor 24 comprises a stator coil 26 arranged outside of the tube housing 8. During the rotation of the rotating anode plate 14, the target region 16 is bombarded with an electron beam emanating from the cathode 10 so that an x-ray beam is emitted as bremsstrahlung. For this the cathode 10 is correspondingly aligned on the target region 16. The x-ray beam emitted by the target region 16 leaves the tube housing 8 through the window 12. The rotating anode plate 14 is produced from molybdenum. The target region 16 is temperature-hardened with tungsten.

The magnetic bearing 4 has both a magnetic axial bearing 34 and a magnetic radial bearing 36 to support the shaft 18. Both magnetic bearings can be realized passively by permanent magnets and/or as actively regulatable electromagnets. Overall, the rotating anode unit 3 is held above its shaft 18 via the magnetic bearing 4 without contact both in the axial direction and in the radial direction in the tube housing 8.

The magnetic bearing 4 has a number of shaft-side rotor components 38, 29 and a number of housing-side stator components 40, 41. The stator components 40, 41 are arranged outside of the tube housing 8. The rotor components 38, 39 associated with the shaft are fashioned from a temperature-adapted, ferromagnetic material. The stator components 40, 41 are fashioned as regulatable, active axial or, respectively, radial stabilization magnets.

In order to suppress a heat conduction from the rotating anode plate 14 to the shaft 18, this is thermally decoupled from the rotating anode plate 14. For this purpose, the shaft 18 is connected with the rotating anode plate 14 via a heat insulation element 49. A radiation protection shield 52 to shade the shaft 18 from a radiant heat emanating from the rotating anode plate 14 during the operation is additionally provided in the tube housing 8. The heat insulation element 49 has a disc-shaped heat insulation part 50 made of ceramic. The heat insulation part 50 is connected with the rotating anode plate 14, i.e. is hard-soldered or bolted. The heat insulation part 50 is connected with the shaft 18 via a hollow tube 64, and thus with a reduced radial cross section.

Due to the small cross sectional area of the hollow tube 64, a geometry-dependent portion of the heat conduction is affected so that the heat transfer from the rotating anode plate 14 to the shaft 18 is additionally hindered.

Figure 2:
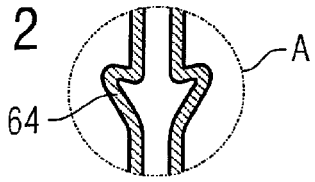
FIG. 2 shows an embodiment of the heat insulation element in a detail view.
Figure 3:
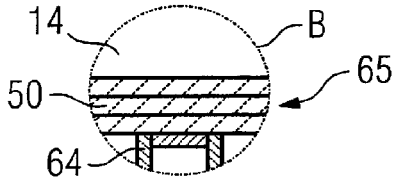
FIG. 3 shows an additional embodiment variant of the heat insulation element.

In one embodiment, the walls of the hollow tube 64 are distended in the axial direction in order to extend the bridging heat path. This embodiment is apparent from the detail variant A drawn in FIG. 2. To further reduce the heat conduction rating, in another or an additional embodiment the heat insulation part 50 is designed as a layer body 65 that is composed of a number of ceramic layers in the axial direction. This is shown in the detail view B according to FIG. 3. The heat transfer is additionally hindered via the adjoining of multiple layers, in particular made of different ceramics, since respective interfaces must be crossed. The interfaces are additionally structured to reduce the direct contact area.

Overall, an effective thermal decoupling of the rotating anode plate 14 from the shaft 18 is achieved via the heat insulation element 49. A heat transfer from the rotating anode plate 14 to the components of the magnetic bearing 4 is thus blocked.

The radiation protection shield 52 is arranged in the x-ray tube 2 between the rotating anode plate 14 and the shaft 18. The radiation protection shield 52 is executed as a metal plate, in particular as a plate of molybdenum or a molybdenum alloy. The plate has a central recess 68 through which the heat insulation element 49 is directed. The magnetic bearing 4 is thus shaded from the rotating anode plate 14. Via the coupling of the radiation protection shield 52 to the tube housing 8, absorbed heat is discharged to the tube housing 8.

The rotating anode plate 14 is directly thermally coupled to the tube housing 8 via a massive, central pin 70 made of molybdenum. For this purpose, the tube housing 8 has a receptacle space 74 filled with a liquid metal 76. The pin 70 projects into the liquid metal 76. A rotatable thermal coupling between the rotating anode plate 14 and the tube housing 8 is formed in this way. The receptacle space 74 is formed in an upper wall 77 of the tube housing 8. For this purpose, a bushing 72 made of molybdenum is inserted into the tube housing 8. As an alternative to this, it is possible to fashion the container 72 as one piece with the tube housing 8. As can be seen from the depiction, the upper wall 77 is executed with a relatively high axial wall thickness 78 and is additionally permeated with a number of cooling channels 56. The liquid metal 74 is present as a gallium alloy.

The pin 70 and the receptacle space 74 do not form a slide bearing. The gap measurement of the gap filled by liquid metal 76 between the gap 70 and the inner wall of the receptacle space 74 is approximately 100 μm.

In order to prevent draining of the liquid metal 76 from the receptacle space 74, a drain barrier 79 is provided, which can be formed by a region provided with an "anti-wetting" layer.

The heat of the heated rotating anode plate 14 is directly transferred to the tube housing 8 via the thermal coupling of the pin 70 to the upper wall 77 of the tube housing 8. The upper wall 77 hereby absorbs the heat from the rotating anode plate 14 and emits it to the coolant directed in the cooling conduits 56. The coolant is directed in the cooling conduits 56 in the manner of a coolant circuit.

An x-ray device 1 of the shown type offers the advantage of a contract-free bearing of the shaft 18 by a magnetic bearing 4, whereby high rotation speeds can be reached. The rotating anode plate 14 dips with a pin 70 into a receptacle space 74 of the tube housing 8 filled with liquid metal 76. During operation, heat is thus directly discharged from the rotating anode plate 14 to the tube housing 8 via the pin 70. The shaft 18 (and thus the magnetic bearing 4) is additionally thermally decoupled from the rotating anode plate 14 by a heat insulation element 49. High rotation speeds of the rotating anode unit 3 thus can be achieved so that the power supplied to the cathode 10 can be further increased in a desirable manner without reaching the temperature limits of the rotating anode plate 14 nor of the magnetic bearing 4.

Although modifications and changes may be suggested by those skilled in the art, it is the intention of the inventor to embody within the patent warranted hereon all changes and modifications as reasonably and properly come within the scope of his or her contribution to the art.

I claim as my invention:

1. An x-ray device comprising:

an evacuated tube housing;

a cathode in said tube housing that emits an electron beam;

a rotating anode unit mounted in said tube housing to rotate around a rotational axis;

said rotating anode unit comprising an anode plate having a target region on which said electron beam is incident to emit x-rays therefrom with an associated generation of heat, and a shaft connected to said anode plate at a first side of said anode plate;

a magnetic bearing that provides contact-free magnetic support of said shaft to allow rotation of said shaft and said anode plate in said housing;

a receptacle in said tube housing having a receptacle wall, said receptacle containing a thermally conductive fluid; and an axial extension extending from said anode plate at a second side thereof, opposite said first side, said axial extension projecting into said receptacle and forming a gap between said axial extension and said receptacle wall in a range between 100 μm and 200 μm, said thermally conductive fluid filling said gap and forming a non-bearing heat dissipater that conducts said heat away from said anode via said axial extension.

2. An x-ray device as claimed in claim 1 wherein said thermally conductive fluid in said receptacle space is a liquid metal.

3. An x-ray device as claimed in claim 1 wherein said axial extension is comprised of a material selected from the group consisting of molybdenum, a molybdenum alloy, and corrosion-resistive coated stainless steel.

4. An x-ray device as claimed in claim 1 wherein said axial extension comprises a central pin comprised of solid material.

5. An x-ray device as claimed in claim 1 wherein said receptacle space is formed by a bushing in said tube housing.

6. An x-ray device as claimed in claim 5 wherein said bushing comprises a material selected from the group consisting of molybdenum, a molybdenum alloy, and a corrosion-resistive coated stainless steel.

7. An x-ray device as claimed in claim 1 comprising a cooling arrangement in thermal communication with said receptacle space.

8. An x-ray device as claimed in claim 7 comprising a cooling conduit in said tube housing in which a coolant circulates, said cooling conduit being in thermal communication with said receptacle space.

9. An x-ray device as claimed in claim 1 comprising a heat insulating element located between, and connecting, said anode plate and said shaft.

10. An x-ray device as claimed in claim 9 wherein said heat insulating element comprises a ceramic part.

11. An x-ray device as claimed in claim 10 wherein said ceramic part has a layer structure comprising a plurality of layers of different materials proceeding in an axial direction, said layers respectively adjoining each other with grooved surfaces.

12. An x-ray device as claimed in claim 9 wherein said heat insulating element is connected with said shaft through a reduced radial cross-section.

13. An x-ray device as claimed in claim 9 wherein said heat insulating element is comprised of a ceramic part and a hollow tube extending in the axial direction.

14. An x-ray device as claimed in claim 13 wherein said hollow tube has a tube wall that is axially distended to extend a heat conducting path of said hollow tube.

15. An x-ray device as claimed in claim 1 comprising a thermal radiation protection shield located between said anode plate and said shaft.

16. An x-ray device as claimed in claim 15 wherein said shield is attached to said tube housing.

17. An x-ray device as claimed in claim 15 wherein said shield is formed as a metal plate.

* * * * *